United States Patent [19]

Wigemark

[11] 4,176,423

[45] Dec. 4, 1979

[54] CARRYING HANDLE FOR CARRIER BOXES OR LIKE CONTAINERS

[75] Inventor: Bertil V. Wigemark, Goteborg, Sweden

[73] Assignee: Bertil Wigemark AB, Sweden

[21] Appl. No.: 869,172

[22] Filed: Jan. 13, 1978

Related U.S. Application Data

[63] Continuation-in-part of Ser. No. 725,267, Sep. 21, 1976, abandoned.

[30] Foreign Application Priority Data

Sep. 23, 1975 [SE] Sweden ..... 7510638

[51] Int. Cl.[2] ..... B65D 25/28

[52] U.S. Cl. ..... 16/125; 220/94R; 224/45 P; 229/52 A

[58] Field of Search ..... 294/16, 27 R, 27 H, 294/33; 16/114 R, 114 B, 119, 125; 5/345 B; 190/39, 57; 206/163; 224/45 H, 45 P; 229/52 A, 52 AL

[56] References Cited

U.S. PATENT DOCUMENTS

| | | | |
|---|---|---|---|
| 2,128,723 | 8/1938 | Zettler | 229/52 A |
| 3,016,136 | 1/1962 | Poupitch | 16/125 X |
| 3,044,105 | 7/1962 | Wigemark | 16/125 |
| 3,301,586 | 1/1967 | Lisiecki | 294/16 |

FOREIGN PATENT DOCUMENTS

| | | | |
|---|---|---|---|
| 1242320 | 8/1960 | France | 229/52 A |
| 1232339 | 10/1960 | France | 229/52 A |
| 1000766 | 8/1965 | United Kingdom | 224/45 P |

*Primary Examiner*—Johnny D. Cherry
*Attorney, Agent, or Firm*—Robert E. Burns; Emmanuel J. Lobato; Bruce L. Adams

[57] ABSTRACT

A detachable and easily insertable handle made of non-rigid plastics to be inserted into slots formed in containers such as carrier bags, suitcases, boxes and the like of cardboard, plastics and similar material to facilitate carrying of the container. The handle comprises a central grip portion having locking plates at each end extending in the longitudinal direction of the grip portion and arranged at an angle of preferably about 45° thereto. The locking plates diverge in the lifting direction of the handle.

4 Claims, 10 Drawing Figures

CARRYING HANDLE FOR CARRIER BOXES OR LIKE CONTAINERS

CROSS-REFERENCE TO EARLIER APPLICATION

This is a continuation-in-part of the earlier application, Ser. No. 725,267, filed Sept. 21, 1976, now abandoned.

BACKGROUND OF THE INVENTION

From U.S. Pat. No. 3,044,105 and the Swedish Pat. No. 227,018 it is known to use detachable handles for carrier bags, boxes, suitcases and like containers of cardboard or similar material, which handles are made of molded non-rigid plastics, are provided at their ends with elongate locking plates which extend in the longitudinal direction of the handle, and are intended to be inserted into slots punched in the container to secure the handle thereto. Difficulties were encountered with earlier handles of this type, particularly in connection with the mounting thereof on the container.

SUMMARY OF THE INVENTION

The present invention relates to the indicated type of carrying handles and more precisely is a further development and improvement thereof. In the new handle, at the central parts of said locking plates, which are continuous in the transverse plate direction and interconnected via the grip portion of the handle, the locking plates advantageously normally extend at an angle of between 20° and 50°, preferably about 45°, to the end straps of the handle grip portion. Desirably the locking plates diverge in the lifting direction of the handle.

The angular position of the locking plates makes it very easy to mount the handle. Due to the locking plates forming an acute angle to the grip portion of the handle, the strips by which the respective locking plate merges into the grip portion need be bent only very slightly to allow the locking plates to be moved into a flat position against their respective strap. As a consequence, the slots made in the container and into which the locking plates together with their straps are to be inserted, may be relatively narrow. An advantage thereof is that a tight container is obtained, i.e. the narrow slots do not permit introduction of rain and dust particles into the interior of the container. Although the angular position of the locking plate certainly may be below 20°, this is not advisable as it would involve the risk that the locking plate, after having been inserted through its associated slot in the container, may not spring back into its outer position but instead slide out through the slot when a pulling force is exerted on the handle. The lower limit for the angular position therefore is set at 20°. Another inevitable disadvantage of too small an angle is that the edges of the central parts of the locking plates, i.e. the edges inside the acute angle between the locking plate and the grip portion of the handle, may have a cutting effect on the container when the latter is carried with consequential rupture of the cardboard of the container adjacent the slot.

According to a preferred embodiment, the support faces of the locking plates, i.e. the areas which are situated on either side of the central parts of the plates and which engage the container upon carrying of the latter, extend at an angle to one another of less than 180°. When the container is carried, those portions of the locking plates that are positioned adjacent the plate ends will therefore first be pressed against the container. As a result the pressure exerted during carrying is levelled out and distributed comparatively evenly on the entire support face of the locking plates. The rupture of the cardboard adjacent the slot commonly experienced with carrying handles of prior-art constructions is thus eliminated, even if a vigorous pulling force is exerted on the handle.

BRIEF DESCRIPTION OF THE DRAWINGS

The invention will be described in more detail in the following with reference to the accompanying drawings, wherein.

DETAILED DESCRIPTION OF A PREFERRED EMBODIMENT

Figure 1:
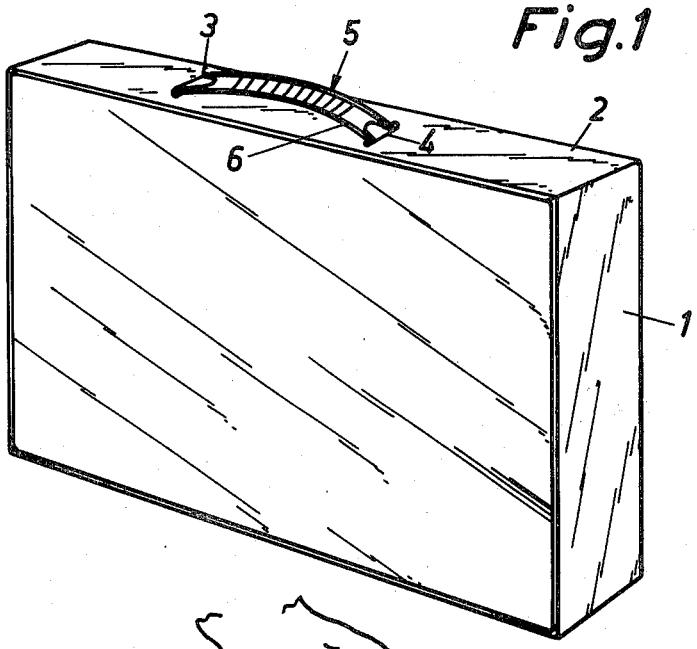
FIG. 1 is a perspective view of a cardboard carrier case equipped with a handle in accordance with the invention.
Figure 2:
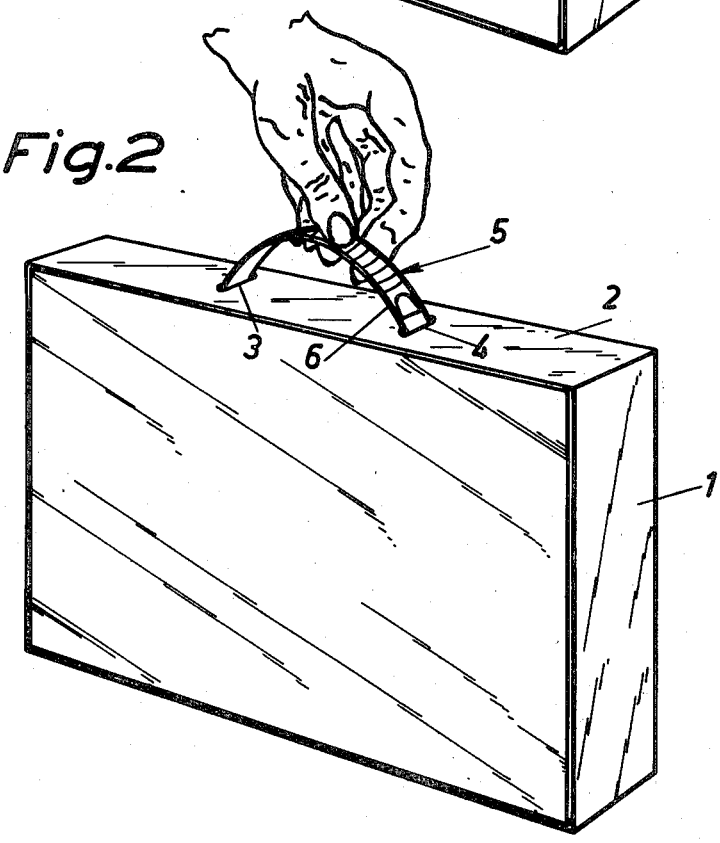
FIG. 2 is a similar view illustrating the handle in carrying position.

In the carrier case 1 illustrated in FIGS. 1 and 2, two slots 3, 4 spaced some distance apart, are made in the upper portion 2 of the case and through these slots are inserted the ends of the handle 5.

Figure 3:
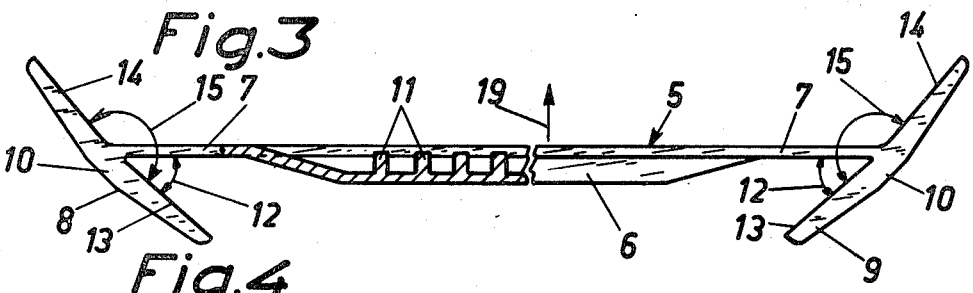
FIG. 3 illustrates on an enlarged scale a side view of a handle in accordance with the invention.
Figure 4:
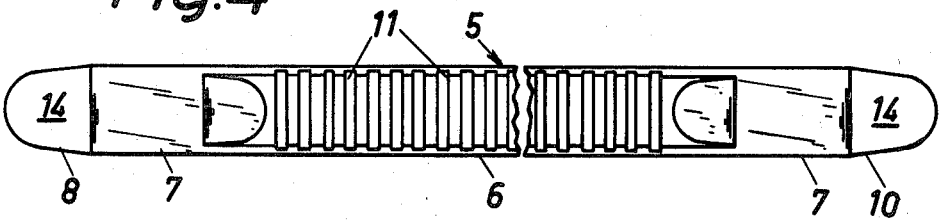
FIG. 4 is a plan view of this handle.

The handle 5 is a one-piece molding of non-rigid flexible plastics, preferably polyethylene. It comprises an elongate central grip portion 6 having a U-shaped cross-sectional configuration, as will be realized from FIGS. 3 and 4. Two flat bandlike straps 7 extend in the longitudinal direction of the grip portion, outwardly from its ends, in both directions from the upper edge of the grip portion. The outer ends of the straps 7 support one elongate locking plate 8, 9 each, these locking plates extending in either direction from their associate straps and each having a reinforced central portion 10, extending continuously across the plate and defining a plate-connector. The width of strap 7 advantageously equals the central one of the locking plate. The locking plates desirably taper equally toward their ends, as shown. Each strap desirably is somewhat larger than one of the tapering portions or straps of the corresponding locking plate.

The grip portion 6 is provided on its inner face with transverse ridges 11 with which engages the thumb of one hand upon application of the handle to the carrier case 1 (FIG. 2). By the provision of the ridges 11, the grip is strengthened. At the same time frictional engagement between the thumb and the grip portion 6 increases, which facilitates the insertion of the locking plates 8, 9 through the slots 3, 4.

Figure 7:
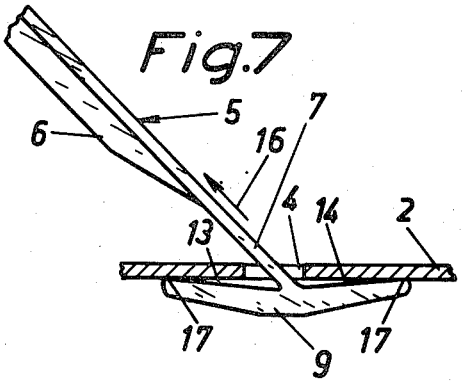
Figure 8:
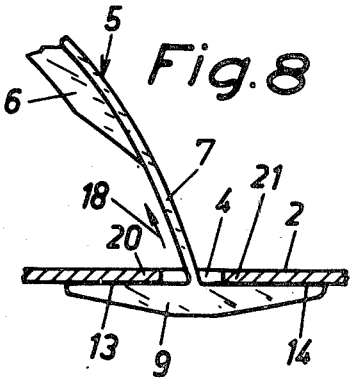

The locking plates 8, 9 normally (in their free condition) extend at an acute angle 12 to the straps 7, as shown, at an angle of about 45° and in any event at an angle of 20° to 50°, at the reinforced central part 10. The areas 13, 14 of the locking plates 8, 9 which upon use of the handle 5 serve as support faces in engagement with the inner face of the upper part 2 of the case 1 are resiliently disposed at an angle 15 to one another of slightly less than 180° (FIGS. 7, 8).

Figure 5:
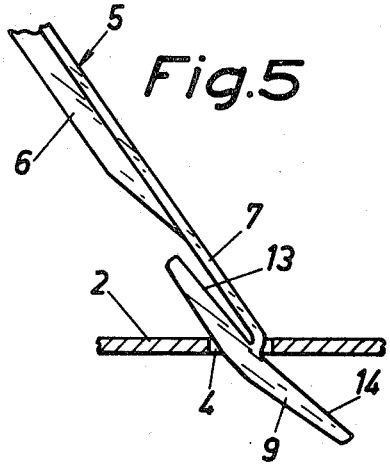
FIGS. 5–8 are sectional views through the upper portion of the carrier case, illustrating one handle end during various stages of application of the handle to the case.
Figure 6:
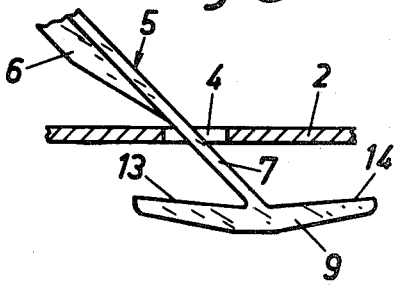

When the carrying handle 5 is to be applied to the case, the locking plate 9 and the associated strap 7 can be gripped by two fingers and bent in the manner illustrated in FIG. 5. The handle end is then introduced through the slot 4. Owing to the locking plate having been given an oblique position relative to its associated strap 7 already in the manufacture of the handle, the locking plate is easily bent into this illustrated position flat against the strap 7. To allow for easy introduction through the slot 4, the length of the strap 7 must somewhat exceed half the length of the locking plate 9. Once inserted into the case, the locking plate 9 springs back outwards to the position illustrated in FIG. 6 on account of the inherent resiliency of the plastic material in which position the support faces 13, 14 of the locking plate 9 will be positioned essentially in parallel with the upper portion 2 of the case. The locking plate 8 is introduced through the slot 3 in an identical manner. When the handle 5 is pulled in the direction illustrated by arrow 16 in FIG. 7, the outer ends 17 of the support faces 13, 14 of the locking plate 9 are the first to move into abutment against the upper case portion 2, with the result that the carrying pressure is first transferred by these outer ends of the locking plate 9 to the upper portion 2. Upon continued pulling on the handle 5 in the direction illustrated by arrow 18 in FIG. 8—the lifting direction of the handle is indicated by arrow 19 in FIG. 3—the whole of support faces 13, 14 of the locking plate 9 are pressed against the upper portion 2. Consequently, there is no risk that excess stress be exerted on the cardboard areas 20, 21 on either side of and close to the slot 4, not even when the handle 5 is rapidly twisted or pulled vigorously.

Figure 9:
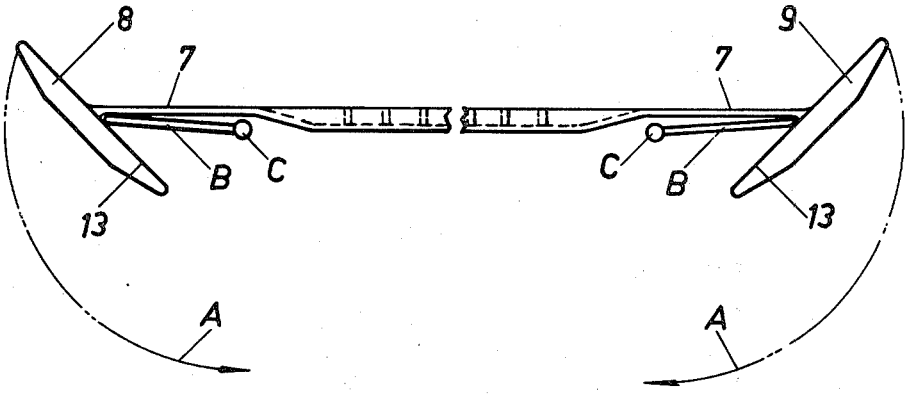
FIGS. 9 and 10 are generally similar views, illustrating two stages of an automatic application of the handle to the case.
Figure 10:
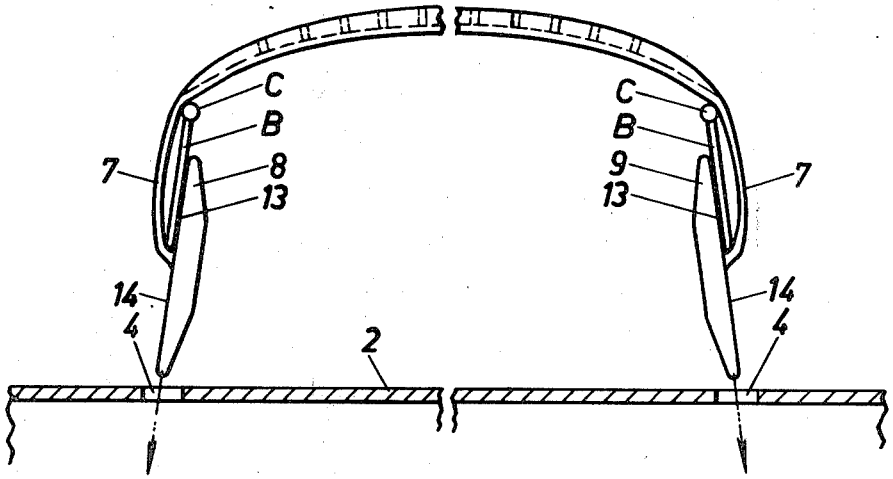

When the new carrying handle is to be inserted automatically, this can be done expeditiously, by virtue of the new construction and mainly of the fact that the locking plates 8, 9 are at an angle of between 20° and 50° to the straps 7. Because of this arrangement, the straps may be bent by means of flat bars B (FIGS. 9, 10) for the insertion of the handle through the box holes 3,4. This insertion is easily carried out by a machine. The flat bars B are inserted, each in the acute-angular space between a strap portion 7 and its locking plates 8, 9, the bars lying flat along the lower faces of the strap portions. The flat bars are thereafter rotated by the machine around an axis C at the inner edge of said flat bars B, so as to force the locking plates 8,9 down from their original (FIG. 9) position, correspondingly to bend the straps 7, and ultimately to place the bars in a new position (FIG. 10), in which they lie flat along the corresponding surface on support face 13 of the locking plates. It will be noted that in this new (FIG. 10) position the locking plates 8, 9 are almost vertical, being rotated, in the illustrated embodiment, by a relatively wide, obtuse angle (arrow A) and into a position almost normal to the top surface 2 of the container. In this new position the locking plates are easily inserted through slots 3,4, in cardboard box top 2. When the locking plates 8,9 are introduced into the box (FIGS. 5 and 6), bars B are withdrawn and the inherent resiliency of the locking bars forces the latter to assume the correct position, with the support faces 13 and 14 abutting against the lower face of the cardboard box top, as illustrated in FIGS. 7 and 8 of the drawings.

The U-shaped portion 6 has a rounded lower configuration matching the fingers of the carrier's hand and the case 1 therefore is comfortable to carry. This applies when the handle is molded. However, the invention also is applicable to carrying handles manufactured by extrusion thereof in the form of elongate strips in which case the locking plates 8, 9 are positioned at the longitudinal edges of the strap and the carrying handles are provided through severing the strip in the transverse direction into straps of sufficient widths.

The design of the carrying handle 5 can be altered in a variety of ways, within the scope of the appended claims. Of course the new handle also is applicable to other types of containers than the one illustrated in the drawings.

What is claimed is:

1. A handle unit for ready attachment to a container having in one side two parallel spaced-apart slots, said handle unit comprising a one-piece molding of flexible resilient plastic material having an elongate central grip portion, two like integral flexible flat band-like strap portions extending from opposite ends of said central grip portion, and an elongate locking plate at the outer end of each of said strap portions, each of said locking plates having a thicker midportion which is the same width as the respective strap portion and is integrally joined thereto and like integral inner and outer wing portions extending in opposite directions from said midportion, said wing portions having flat upper faces and rounded tips and being of decreasing width and thickness proceeding from said midportion to said tips, said strap portions having a length greater than said inner wing portions, and said upper faces of said inner wing portions of said locking plates in relaxed condition of said handle unit unattached to a container, as viewed in side elevation, being inclined at an angle of 20° to 50° to the adjacent strap portion and said upper faces of said outer wing portion being inclined to said strap portion at an angle of approximately 160° to 130° but with the sum of said angles of said upper faces of said inner and outer wing portions to said strap portion being slightly less than 180°, whereby said handle unit is attachable to said container automatically by inserting flat bars in the acute angles between said strap portions and said inclined inner wing portions of the respective locking plates, rotating said flat bars to direct said locking plates toward said slots in the container side and bring said inner wing portions close to said strap portions, moving said flat bars toward said container to insert said locking plates and adjacent strap portions through said slots in said container side, and withdrawing said flat bars, whereupon said locking plates resiliently return to their inclined positions relative to said strap portions, whereby said locking plates are approximately parallel to said container side with said strap portions inclined toward one another, and thereupon exerting tension on said strap portions to bring both said inner and outer wing portions of said locking plates uniformly against the inner face of said container side on opposite sides of said slots so as to distribute the load imposed by said locking plates on said container side.

2. A handle unit according to claim 1, in which the angle of inclination of said locking plates to said strap portions in relaxed condition is approximately 45°.

3. A handle unit according to claim 1, in which said central grip portion of said handle unit has a downwardly rounded, U-shaped cross-section to facilitate carrying said container.

4. A handle unit according to claim 3, in which the upper side of said central grip portion is concave and has longitudinally spaced cross bar portions extending transversely of said central grip portion.

* * * * *